US005233738A

United States Patent [19]

Finkbeiner et al.

[11] Patent Number: 5,233,738

[45] Date of Patent: Aug. 10, 1993

[54] TOOL FOR FINE MACHINING

[75] Inventors: Ludwig Finkbeiner, Walheim; Manfred Wilhelm, Nussdorf, both of Fed. Rep. of Germany

[73] Assignee: Robert Bosch GmbH, Stuttgart, Fed. Rep. of Germany

[21] Appl. No.: 864,616

[22] Filed: Apr. 7, 1992

[30] Foreign Application Priority Data

May 31, 1991 [DE] Fed. Rep. of Germany ..... 4117814

[51] Int. Cl.[5] ..... B24B 39/02; B24B 39/04; B23P 9/02; B21C 37/30

[52] U.S. Cl. ..... 29/90.01; 72/370; 72/479

[58] Field of Search ..... 29/90.01; 72/370, 391.2, 72/479

[56] References Cited

U.S. PATENT DOCUMENTS

| | | | |
|---|---|---|---|
| 1,441,502 | 1/1923 | Hook | 407/1 |
| 1,477,266 | 12/1923 | Jenking | 407/1 |
| 4,282,734 | 8/1981 | Eddy | 72/370 |
| 4,573,340 | 3/1986 | Kammeraad | 72/479 |
| 4,771,627 | 9/1988 | Speakman | 29/90.01 |

FOREIGN PATENT DOCUMENTS

| | | | |
|---|---|---|---|
| 841111 | 6/1952 | Fed. Rep. of Germany . | |
| 471144 | 5/1975 | U.S.S.R. | 72/479 |
| 594192 | 2/1978 | U.S.S.R. | 29/90.01 |
| 733891 | 5/1980 | U.S.S.R. | 29/90.01 |
| 753562 | 8/1980 | U.S.S.R. | 29/90.01 |
| 1196143 | 12/1985 | U.S.S.R. | 29/90.01 |

*Primary Examiner*—William E. Terrell
*Attorney, Agent, or Firm*—Michael J. Striker

[57] ABSTRACT

A tool for machining of openings, shafts and the like has a body having concentrical stepped cylindrical working regions, grooves provided between the working regions, and transitional regions arranged between the grooves and the cylindrical working regions. The transitional regions extend substantially tangentially in a machining direction and a deformation process of an outer surface of the workpiece to be machined is performed without material removal by compression.

6 Claims, 3 Drawing Sheets

TOOL FOR FINE MACHINING

BACKGROUND OF THE INVENTION

The present invention relates to a tool for fine machining of surfaces of openings, shafts and the like. More particularly it relates to a tool for fine working, which has grooves provided between concentric stepped working regions.

Such tools, such as for example broaching tools, broaching needles and the like operate with a material removal. Thereby the machine surfaces substantially have no optimal smoothness. This is however required in special cases, for example when machining of housing openings for control sliders of valves.

SUMMARY OF THE INVENTION

Accordingly, it is an object of the present invention to provide a tool of the above mentioned general type which can machine the surfaces not in a material removing manner, but instead in material compressing manner and thereby provides not only an extremely high size accuracy but also an extremely smooth and high strength surface.

In keeping with these objects and with others which will become apparent hereinafter, one feature of the present invention resides, briefly stated, in a tool in which transitional regions between grooves and cylindrically shaped working regions extend at least substantially tangentially in a machining direction and a deformation process of a surface of a workpiece to be machined is performed without material removal by compression.

When the tool is designed in accordance with the present invention it achieves the above mentioned objects. The tool also produces a precision-micro deformation of the outer surface of the material. Machining, depending on the type of the tool can be both provided for inner surfaces for example openings, and also for outer surfaces for example shafts, axles and the like.

In accordance with another feature of the present invention the working regions of the tool are substantially stepped and cylindrical.

Still another feature of the present invention is that the tool is formed as a mandrel and the working regions have a diameter increasing from one side to a greater diameter.

The mandrel can have a guiding region, then a centering region, then an inlet smooth region, then a working region composed of several fine working stages, and then an outlet incline with subsequent outlet straight region.

In accordance with another feature of the present invention the tool is hollow cylindrical, at the smallest diameter of the working region is located at its one end and thereby is suitable for machining of shafts, axles and the like. The working regions can have a round cross-section.

Finally, the tool includes a base body of high grade sintered steel, an intermediate layer of nickel applied electrolytically in the working region, and a hard layer especially pure titanium, and the outer surface of the tool after the coating is finally grinded, compressed and smoothed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
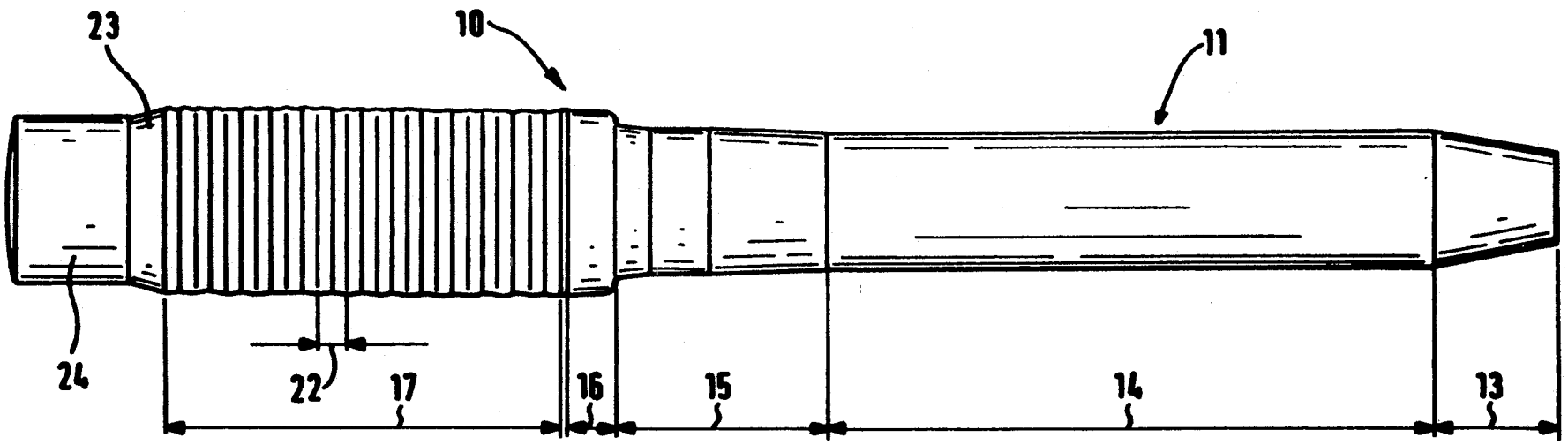
FIG. 1 is a view showing a smoothing tool in accordance with the present invention.

A precision smoothing tool is formed as a smoothing mandrel 10 which is used for end machining, in other words for producing the most accurate diameter size for example an opening by compressing its surface without material-removal. Prior to discussing the material of the tool, the tool geometry is to be described. It has a cylindrical shaft 11 with an inlet inclined portion 13 at its one end and a following guiding straight portion 14. Then it has a centering region 15 and then a step with a rounded transition. Then there is an inlet smoothing inclined portion 16 and then a so-called fine stage 17 which forms a working region proper. The fine stage 17 has a plurality of grooves 18 which are arranged concentrically one behind the other. Working stages 19 are located between the grooves 18 and are formed as cylindrical or straight regions.

Figure 2:
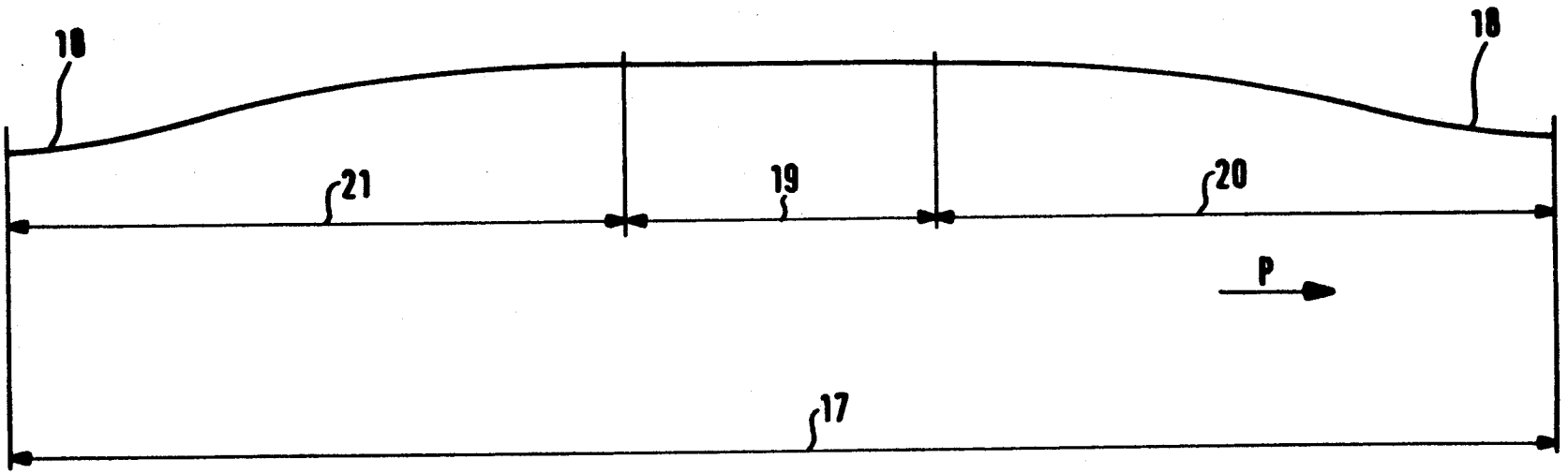
FIG. 2 a view showing a detail of the smoothing tool of FIG. 1.

A transition region between respective grooves 18 and the working stage is very important. This transitional region is formed as an inlet curve 20 which extends in the movement direction of the tool as shown in FIG. 2 and identified with the arrow P. In the region located behind it, it is formed as an outlet curve 21. The transition from each groove 18 to each working stage 19 is therefore performed tangentially.

The greatest diameter of the working stage 19 is located at the end of the fine stage 17. At the end of the fine stage 17 which is opposite to the shaft 11, an outer inclined portion 23 is provided. Then an outlet straight portion 24 is located. The diameter difference of the individual working regions in the fine stage 17 amount to approximately 0.2–0.3 micrometers, or in other words it is extremely low.

Figure 3A:
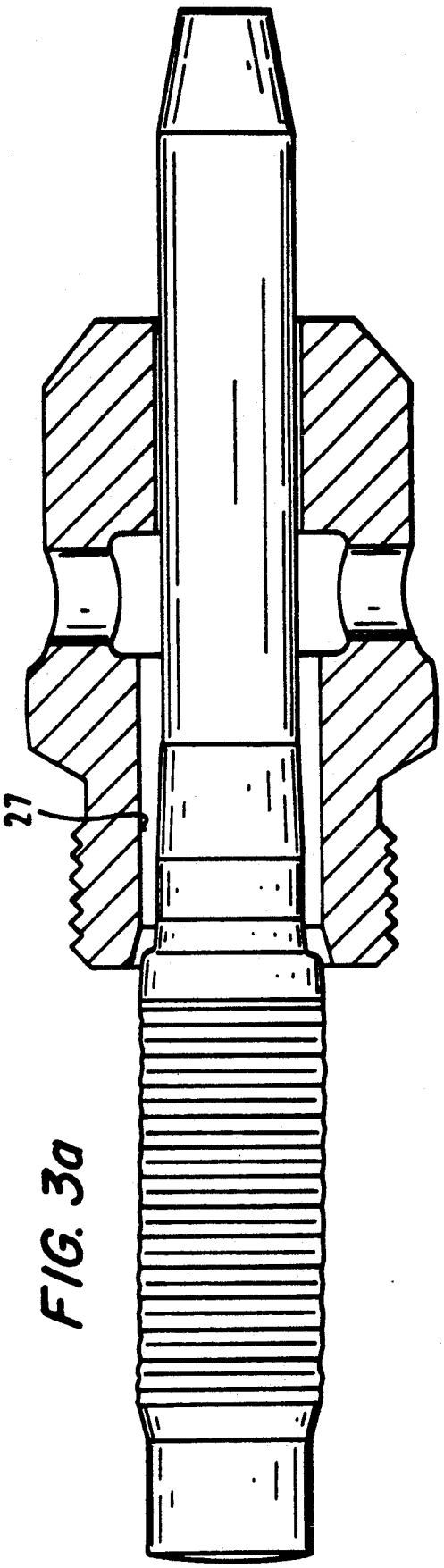
FIGS. 3*a* and 3*b* is a view showing a machining process with the tool of the present invention.
Figure 3B:
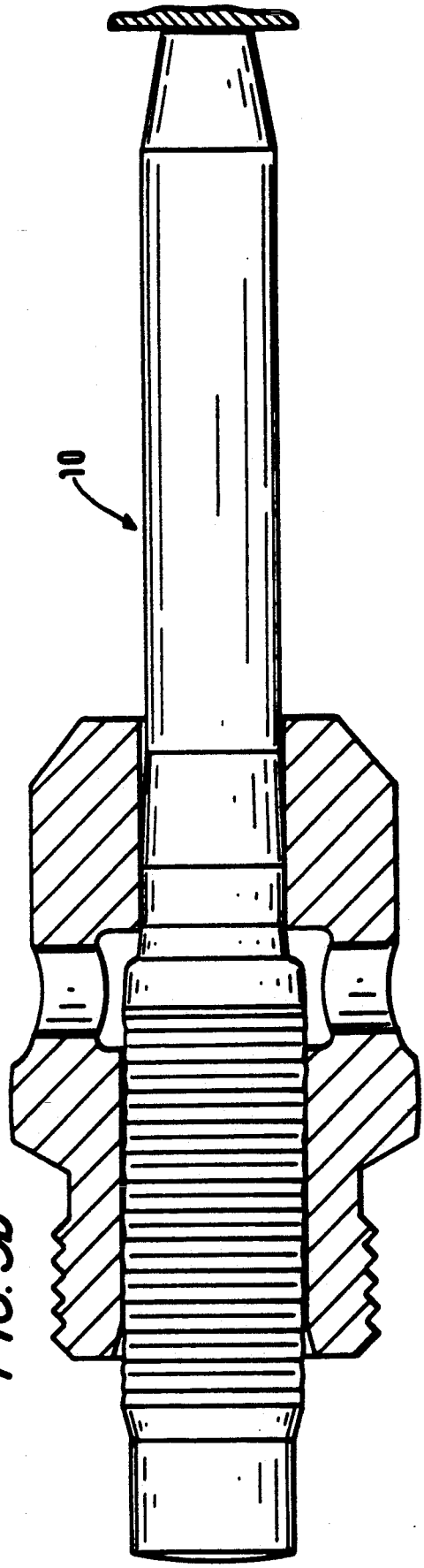

FIG. 3 shows a machining example for the smoothing tool. An opening 27 in the machine part must be made with the maximum accurate diameter, smallest roughness depth and maximum accurate cylindricity. It is performed with the smoothing which during its displacement brings the surface of the opening to the maximum accurate size (here naturally only several micrometers) by compression and not by material removal.

The base material of the precision smoothing tool is for example a high grade steel with a homogenous structure, especially a pressure sintered material with a hardness of 67–69 HRC after hardening in vacuum. For pressure sintering a so-called HIP-process is suitable (high isostatic pressing). The pressure sintering mass which is used for this must have a grain diameter of 3–7 micrometer and a flux, for example nickel, zinc, tin also can be used as a sinter mass with substantially the same grain size. The surface must be free of micro cracks.

A hard layer is supplied on the base material. It hardens at approximately 300% higher than the hardness of the workpiece to be smoothed. First, however, the tool is chemically-mechanically cleaned. Then on the sintered base material, in order to obtain high adhesion of the hard layer a thin intermediate layer of nickel is electrolytically applied to the working surface or the fine stage 17. The intermediate layer has a thickness of approximately 0.2–0.4 micrometers, and it is cohesive with the base material and then with the subsequent hard layer. It is applied also only in the region of the fine stage 17 and composed in the outermost region of TiN with the hardness of 2,000 HV or $TiC_2N$ with a hardness of 2,700–3,200 HV.

For this purpose pure titanium is applied in the PVD process (physical vapor deposition). In addition, as described hereinabove the tool which is electrolytically coated with pure nickel, is heated in a reduction stage to 480° C. for degassing, and the pure titanium is supplied in a protective gas zone. After applying the pure titanium with a layer thickness of 0.3–0.5 micrometers, nitrogen and carbon are introduced in the pure titanium by diffusion until the closed hardness layer of TiN or $TiC_2N$ is produced. Thereby a pure metal layer remains on the surface of the tool. The tool is then treated by finest polishing and then mechanically-chemically cleaned.

After the hard coating the so-called working region or the fine stage of the tool must be compressed and smoothed by definite polishing. The polishing medium must be filtered. After this smoothing the tool must be again mechanically-chemically cleaned with a synthetic plastic stable brush. It should be noted that all free crystals must be removed from the outer surface.

During the use of the tool it is advantageous to utilize a thin flowing lubricant. As such a lubricant it is especially suitable to use a low acid, mineral-organic oil. This first of all is selected in accordance with the workpiece alloy, the workpiece hardness and its outer surface. At the same time it is possible to provide lubrication and cooling with emulsions. A cooling is very important or desirable.

The above described precision smoothing tool is provided for machining of openings. It is however possible to produce a similar tool for the precision machining of for example shafts, axles and the like.

The cross-section of the fine stage or the whole tool is conventionally round. However, it can have also other shapes, for example a polygonal profile, an elliptic profile, etc.

It will be understood that each of the elements described above, or two or more together, may also find a useful application in other types of constructions differing from the types described above.

While the invention has been illustrated and described as embodied in a tool for machining of openings, shafts and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A tool for machining of openings, shafts and the like, comprising a body having an axis extending in a movement direction of the tool, and a working region having a plurality of concentrical stepped straight working surfaces, grooves provided between said working surfaces, and transitional regions arranged between said grooves and said working surfaces, said transitional regions curving smoothly into said grooves and into said working surfaces so that a transition from each of said grooves to a respective one of said working surfaces is performed substantially tangentially in the movement direction and formed so that a deformation process of an outer surface of the workpiece to be machined is performed without material removal and by compression, said body further having successively a guiding region of substantially uniform sectional size, a centering region of nonuniform sectional size, and an inlet smoothing region, said working region being composed of several fine working stages, an outlet region which has a surface inclined relative to said axis, and an outlet straight region which has a surface substantially parallel to said axis.

2. A tool as defined in claim 1, wherein said working regions are stepped in diameter.

3. A tool as defined in claim 1, wherein said body is formed as a mandrel, said working regions having a diameter which increases from one side to a maximum diameter.

4. A tool as defined in claim 1, wherein said body is formed as a mandrel having successively a guiding region, a centering region, and an inlet smoothing region, said working region being composed of several fine working stages, an outlet region which is inclined relative to said axis, and an outlet straight region.

5. A tool as defined in claim 1, wherein said working regions have a round cross-section.

6. A tool as defined in claim 1, wherein said body has a base part composed of high grade sintered steel, an intermediate layer composed of nickel and electrolytically applied on said base part in said working region, a hard layer composed of pure titanium and arranged on said intermediate layer, and an outer surface of said body after coating is finally grinded, compressed and smoothed.

* * * * *